United States Patent [19]

Miller, Jr. et al.

[11] 4,234,141

[45] Nov. 18, 1980

[54] RANGE GATED RETROREFLECTIVE MISSILE GUIDANCE SYSTEM

[75] Inventors: Walter E. Miller, Jr.; Jimmy R. Duke; George W. Starkey; Robert L. Sitton, all of Huntsville, Ala.

[73] Assignee: The United States of America as represented by the Secretary of the Army, Washington, D.C.

[21] Appl. No.: 24,415

[22] Filed: Mar. 10, 1970

[51] Int. Cl.[3] ..... F41G 7/26

[52] U.S. Cl. ..... 244/3.13

[58] Field of Search ..... 244/3.11, 3.13, 3.16

[56] References Cited

U.S. PATENT DOCUMENTS

| | | | |
|---|---|---|---|
| 2,590,574 | 3/1952 | Robinson | 244/3.11 |
| 3,398,918 | 8/1968 | Girault | 244/3.13 |

FOREIGN PATENT DOCUMENTS

| | | | |
|---|---|---|---|
| 859495 | 1/1961 | United Kingdom | 244/3.19 |

*Primary Examiner*—Charles T. Jordan

*Attorney, Agent, or Firm*—Nathan Edelberg; Robert P. Gibson

[57] ABSTRACT

An optical tracking link in an automatic command to line-of-sight missile guidance system improves the system efficiency and employs a reuseable light source. In tracking a missile during trajectory toward a target, short pulses of collimated light are transmitted from the launch site toward the missle. These light pulses are received by a missile optical receiver for guidance of the missile and are simultaneously reflected by a retrodirective prism on the missile. The reflected energy follows a path parallel to the incident wave and is thus directed back to the launch site. A missile tracker at the launch site responds to the reflective energy, measuring any deviation of the missile from a line-of-sight axis maintained between the launch site and a target. Guidance commands are transmitted toward the missile for maintaining the missile on the line-of-sight trajectory and containing correctional signals in response to any missile deviation. During intervals between return reflections, the missile tracker can be gated off. This greatly reduces background and jamming source reflections and signals, received by the tracker providing effective counter measures hardening of the system.

4 Claims, 3 Drawing Figures

RANGE GATED RETROREFLECTIVE MISSILE GUIDANCE SYSTEM

BACKGROUND OF THE INVENTION

An optical beacon is currently provided on automatic command to line-of-sight guided missiles, providing a unique missile signature for automatic tracking and guidance. This signature attempts to provide discrimination against deliberate false targets such as flares, search lights, and other optical jammers. Discrimination should also be provided against normal background interference such as glare, reflection, and fires. These optical signatures, transmitted from missiles, provide a relatively low frequency signal output and are susceptible to optical jammers (false targets) having this same frequency capability.

Typically, a coded light source (active beacon) on the missile is automatically tracked by a tracker located at a launching site. This tracker is also bore-sighted to an optical telescope through which a gunner observes the target. Thus if the gunner places the telescope cross-hairs on a target, the tracker mull axis will also be along this same line-of-sight to the target. The tracker output represents an angular deviation of the coded light source from the line-of-sight and it is used to generate correctional guidance commands to return the missile to the line-of-sight. The missile, through correctional guidance, remains on this line-of-sight trajectory until impact with the target.

A variety of devices have been used as the light source which enables the tracker to identify the missile. A pyrotechnic device, the railroad flare, was one of the earliest types of light source. Modulated sources, such as mechanically chopped tungsten light bulbs and electronically modulated gas arc lamps, have succeeded the railroad flares.

In deliberate attempts to jam missile trackers, the tracking area is saturated with suspected beacon frequencies, attempting to cover the normal span of optical beacon frequencies that may be utilized. Jamming sources for optical beacons include tungsten flare and xenon arc lamps. These jammers are high average intensity devices operated at relatively low frequencies (less than 100 $KH_z$).

SUMMARY OF THE INVENTION

In an automatic command to line-of-sight missile guidance system, a retrodirective prism reflects an optical signal from a missile to an optical tracker. The tracker measures the deviation of the missile position with respect to a line-of-sight axis from the launch site to a target. The deviation is used to generate correctional guidance commands for maintaining correct missile trajectory. After a missile is launched, short pulses of light are transmitted periodically from the launch site. These light pulses, bursts of optical energy, are reflected parallel to the received light by the retrodirective prism on the missile. The reflected burst of energy is thus directed to the tracker at the launch site. The light pulse incident to the missile may also be coded to convey guidance commands to the missile and is received by an optical receiver on the missile.

The light source, optical transmitter, is reuseable since it remains with the launcher. A much narrower light beam can be transmitted since it is always pointed at the missile, providing a much greater intensity of the received signal. Increasing the signal intensity improves false signal rejection and improves efficiency of the system. The transmitted light can be encoded in any desirable fashion, even randomly, and received correctly by the tracker. The tracker is adjacent the transmitter and can be provided with a random code sequence at the time the code is transmitted. For very short duration pulses of transmitted energy, the tracker can be gated on only during the proper time for arrival of the reflected pulses from the known missile range. This effectively eliminates other reflections that occur from objects at other distances from the launcher.

DESCRIPTION OF THE PREFERRED EMBODIMENT

Figure 1:
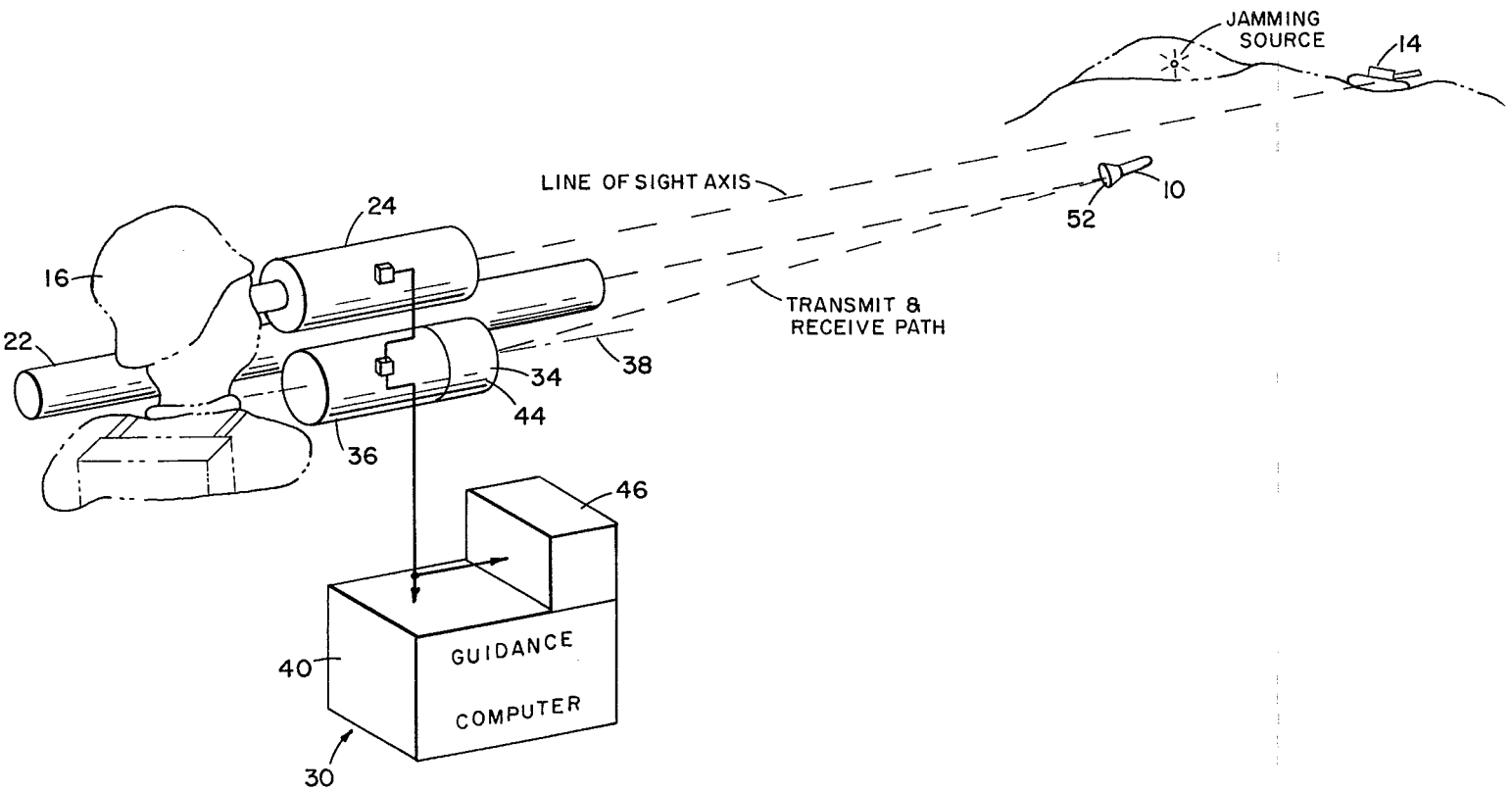
FIG. 1 is a perspective view of an automatic command to line-of-sight guided missile system having a reflective optical missile tracking link.

Referring now to the drawings wherein like numerals refer to like parts in each figure, FIG. 1 discloses a preferred embodiment of the system. A missile 10, launched from a launching tube 22 toward a target 14 has a guidance system including an optical tracking link. To provide missile guidance, an observer 16 establishes and maintains line-of-sight contact with target 14 through a telescope 24. On command, missile 10 seeks to align with the line-of-sight axis between telescope 24 and target 14. Changing the line-of-sight direction of telescope 24, as in tracking a moving target, results in a change in direction of the missile flight as it adjusts trajectory to realign with the moving line-of-sight. Maintaining visual (line-of-sight) contact with the target, therefore, insures missle intercept therewith.

Figure 2:
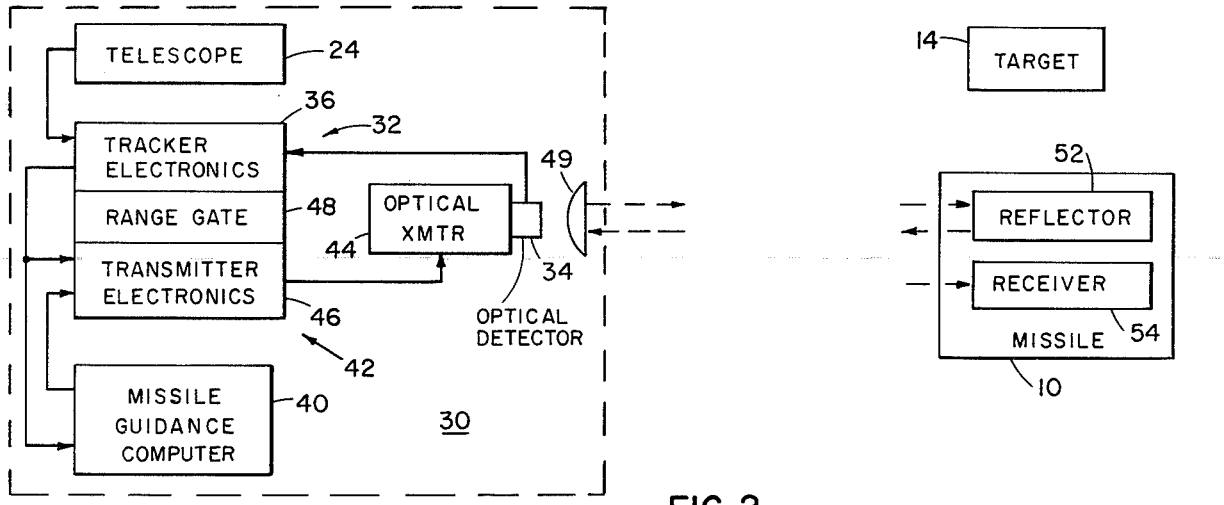
FIG. 2 is a block diagram of an optical transmitter, beacon tracker, and missile employing the inventive concept.

FIGS. 1 and 2 disclose, additionally, a launch site tracking and control station 30, including telescope 24. Tracking station 30 further comprises a missile beacon tracker 32, a missile guidance computer 40 and a transmitter 42. Tracker 32 includes an optical detector 34 connected to related tracker electronics 36. Transmitter 42 includes an optical transmitter 44 connected to related transmitter electronics 46. Tracker detector 34 and optical transmitter 44 are shown removed from the related electronic circuitry and coaxially aligned with a single lens aperture 49 for transmitting and receiving optical energy from missile 10.

Missile tracker 32 is boresighted with telescope 24 so that the tracker null axis 38 is along the telescope line-of-sight axis toward an observed target 14. Tracker circuit 36 is further coupled to transmitter circuit 46 and to the guidance computer 40. Guidance computer 40 receives missile and target tracking data from missile tracker 32 and computes corrective directional signals to maintain tracker null axis along the line-of-sight. A signal from computer 40 is connected to transmitter circuit 46, gating the transmitter on and sending directional signals thereto for encoding into the transmitter output signal. Transmitter 44 can be a laser device or other highly directional light source, either of which can be provided by a gallium-arsenide diode array. A range gate 48 allows tracker 34 to be gated on only during the time for arrival of reflected pulses from the known missile range.

On the aft end of missile 10, a retrodirective prism 52 is mounted adjacent an optically sensitive receiver 54. During trajectory of missile 10 toward target 14, pulses of collimated light are directed from optical transmitter 44 through lens 49 toward the missile. The transmitted light pulses are encoded with directional commands to maintain the missile on line-of-sight trajectory. The encoded light energy is received by missile receiver 54 for guidance of the missile and a portion thereof is reflected by retrodirective prism 52. Following a parallel path to the incident wave, the reflected optical signal is directed back to launch site 30 where it is received by optical tracker 34. This highly directive reflected signal indicates the relative position of missile 10 with respect to the telescope line-of-sight. Tracker 32 being boresighted or ganged with telescope 24 compares the direction of the missile with the line-of-sight direction to the target. Signals indicating deviation of the missile from line-of-sight are coupled from the tracker to missile guidance computer 40. Guidance commands are coupled from computer 40 to transmitter 42 and transmitted toward missile 10 to repeat the tracking cycle.

Figure 3:
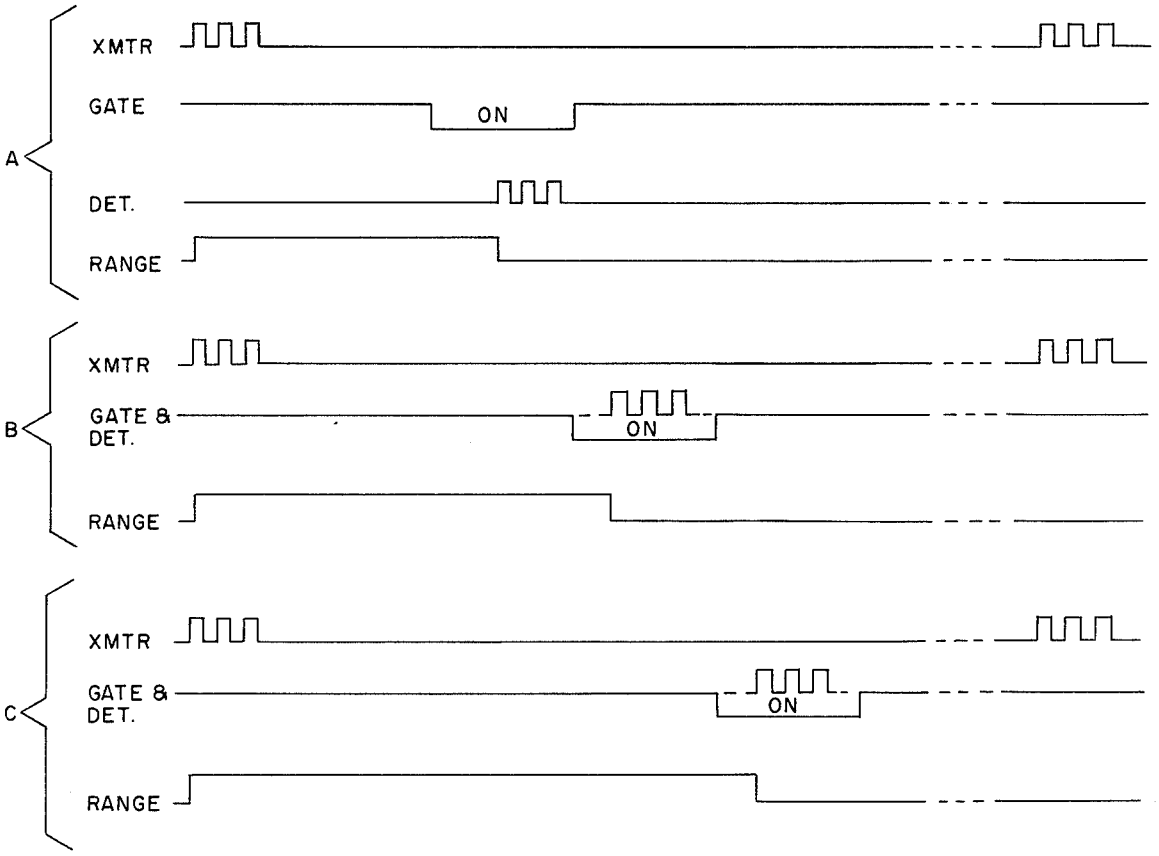
FIG. 3 is a time sequence diagram of the range gating of a tracked missile.

In FIG. 3, typical tracking cycles A, B and C are shown graphically. Each cycle includes a transmitter burst of optical energy, a gate signal for tracker 32, the received reflected signal and the range to the missile. A range indicator can indicate the missile system from the launch site or ranging circuitry may simply denote the missile range for gating missile tracker 32. The range curve of FIG. 3 is shown here merely to indicate the relative timing of gating tracker 32 and receiving the reflected signal. Since the missile is moving away from tracker 32 gating the tracker on is a time variable function and occurs in successive later periods. For example, the gate in cycle A is preselected to activate tracker detector 34 at a specific interval of time after the transmitted pulse or main bang. Missile performance characteristics yield the data required to determine time between transmission pulses and receiver or tracker gating. Early and late gates can also be used for automatic gate tracking of the returned pulse. Detector 34 is gated for a fixed time interval, such as 10 times the transmitted pulse burst period. The sequence of events in cycles B and C of FIG. 3 differ from cycle A only by the increased period of each cycle. The gate is on for identical periods during each cycle. However, the variable delay time period increases in proportion to missile flight during the time interval. As shown in FIG. 3, cycle B gate time is increased by the time interval the gate was on in cycle A. Cycle C gate is activated similarly, thus assuming, for this example, a uniform velocity of missile flight equal to the on gate time.

Retroreflective prism 52 can be a corner cube prism for reflecting transmitted light energy from a gallium-arsenide (Ga-As) laser to an optical detector. By using very short duration light pulses, such as 200 nanosecond pulses from an ambient temperature Ga-As laser, the tracker 32 can be gated on only during the time for arrival of the reflected pulses. This greatly reduces reflections from objects at other distances from the launcher and specifically discriminates against use of a retroreflective as a jamming device. With this pulse width, a range resolution of about 100 feet is obtainable while acceptably tracking one reflector as desired and rejecting reflection from another. Range gating, typically, can be provided as in U.S. Pat. No. 3,366,953 by Myer, although it need not be as complex.

We claim:

1. A range gated retroreflective guidance system for a missile system comprising: an optically sensitive receiver within the housing of a missile to be tracked for command control of said missile, a tracking station having an optical transmitting means for transmitting a periodic burst of light energy toward said missile optical receiver for providing a missile guidance signal, a telescope at said tracking station for maintaining directional alignment between said target and said tracking station, optically sensitive missile tracking means at said tracking station for following the direction of flight of a missile, and a retrodirective corner-cube prism adjacent said optical receiver for reflecting a portion of said optically transmitted guidance signal from said missile to said optical tracking means.

2. A range gated retroreflective guidance system as set forth in claim 1 wherein said optical transmitting means is a gallium-arsenide laser.

3. A range gate retroreflective guidance system as set forth in claim 2 wherein said optically sensitive tracking means comprises an optical detector coaxial to said light emitting transmitter, and a gating circuit for activating said optical detector only during periods of anticipated energy return and for providing an increasing variable delay between the activation of said transmitter and the gating on of said receiver.

4. A method for providing a range gated retroreflective guidance system between a missile and a relatively fixed tracking station, said tracking station being disposed for distinguishing a target and maintaining said missile on a trajectory terminating at said target, comprising the steps of:

(a) maintaining said target in a line-of-sight relationship with an observer at said tracking station, (b) directing an output signal of optical energy from said tracking station toward said missile during traversal of said trajectory, (c) receiving said signal of optical energy by said missile, (d) reflecting a portion of said received optical energy signals from a corner-cube prism on said missile to said tracking station along a path substantially parallel with the path of incidence in immediate response to said received signal, (e) receiving and detecting the reflected optical energy by said tracking station for tracking said missile in the trajectory toward said target, (f) re-directing output signals of optical energy from said tracking station toward said missile for correcting and maintaining the relative position of said missile in the trajectory toward said target, and (g) generating attitude responses within said missile in proportion to relative displacement between the missile and said line-of-sight for retention of said missile in trajectory in response to said tracking station directing and re-directing output signals.

* * * * *